US008864264B2

(12) United States Patent
Rice et al.

(10) Patent No.: US 8,864,264 B2
(45) Date of Patent: Oct. 21, 2014

(54) MULTI-MODE PRINTING

(75) Inventors: Huston W. Rice, Vancouver, WA (US); Jason M. Quintana, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 32 days.

(21) Appl. No.: 13/697,268

(22) PCT Filed: May 11, 2010

(86) PCT No.: PCT/US2010/034393

§ 371 (c)(1), (2), (4) Date: Nov. 9, 2012

(87) PCT Pub. No.: WO2011/142748

PCT Pub. Date: Nov. 17, 2011

(65) Prior Publication Data

US 2013/0063510 A1 Mar. 14, 2013

(51) Int. Cl.

| | |
|---|---|
| ***B41J 29/38*** | (2006.01) |
| ***B41J 2/045*** | (2006.01) |
| ***B41J 2/175*** | (2006.01) |
| ***B41J 2/21*** | (2006.01) |

(52) U.S. Cl.

CPC ..... *B41J 2/17503* (2013.01); *B41J 2/04551* (2013.01); *B41J 2/04543* (2013.01); *B41J 2/0458* (2013.01); *B41J 2/2125* (2013.01)

USPC ..... 347/12

(58) Field of Classification Search

CPC .. B41J 2/04541; B41J 2/0455; B41J 2/04573; B41J 2/0458; B41J 29/38

USPC ..... 347/9–12, 40–42

See application file for complete search history.

(56) References Cited

U.S. PATENT DOCUMENTS

| | | | | |
|---|---|---|---|---|
| 5,675,365 | A | 10/1997 | Becerra et al. | |
| 7,281,784 | B2 | 10/2007 | Eguchi et al. | |
| 8,220,892 | B2 * | 7/2012 | Naoi | 347/11 |
| 8,506,030 | B2 * | 8/2013 | Kurokawa et al. | 347/9 |
| 2002/0008734 | A1 | 1/2002 | Lee et al. | |
| 2009/0015635 | A1 | 1/2009 | Tsukuda | |

FOREIGN PATENT DOCUMENTS

| | | | |
|---|---|---|---|
| EP | 1464495 | A2 | 10/2004 |
| JP | 1996-183179 | | 7/1996 |
| JP | 2005117463 | | 4/2005 |
| JP | 2006-076011 | | 3/2006 |
| JP | 2007-185949 | | 7/2007 |
| JP | 2008-246863 | | 10/2008 |
| KR | 1020070103343 | | 10/2007 |
| TW | I289510 | | 11/2007 |
| TW | I325821 | | 6/2010 |
| WO | WO-2006051762 | A1 | 5/2006 |

* cited by examiner

*Primary Examiner* — An Do

(57) ABSTRACT

A printing system configured for multi-mode printing, the printing system including a print head, the print head including a number of nozzle pairs, each nozzle pair including a primary ink nozzle and a secondary ink nozzle; and switching circuitry for selectively firing either or both of the nozzles in a selected pair within one of a number of time slots based on a current print mode.

19 Claims, 7 Drawing Sheets

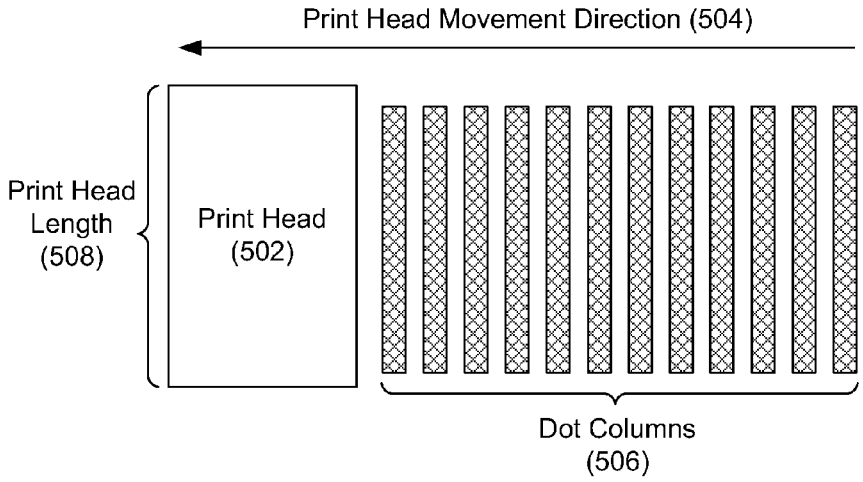
Fig. 5A
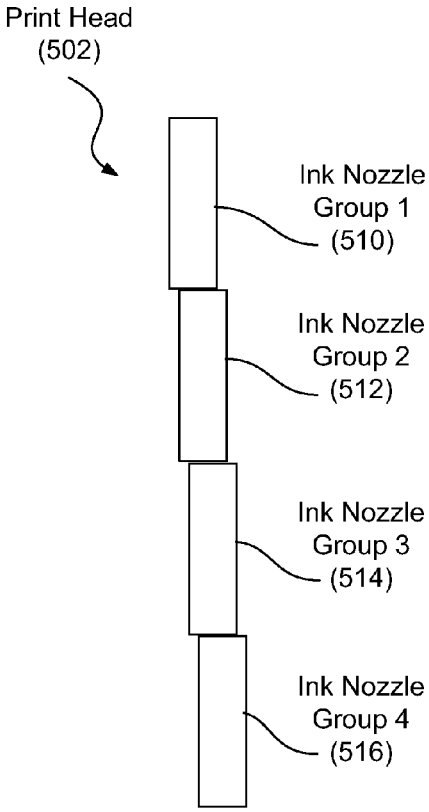
Fig. 5B
| 518 | Example 1 (520) | Example 2 (522) |
|---|---|---|
| **Time Slot** | **Group** | **Group** |
| 1 | 1S | 1S |
| 2 | 1P | 2S |
| 3 | 2S | 3S |
| 4 | 2P | 4S |
| 5 | 3S | 1P |
| 6 | 3P | 2P |
| 7 | 4S | 3P |
| 8 | 4P | 4P |
Fig. 5C

MULTI-MODE PRINTING

RELATED APPLICATIONS

The present application claims the priority under 35 U.S.C. 119(a)-(d) or (f) and under C.F.R. 1.55(a) of previous International Patent Application No. PCT/US2010/034393, filed May 11, 2010, entitled "Multi-Mode Printing," which is incorporated herein by reference in its entirety.

BACKGROUND

Inkjet printers are commonly used both for large scale printing, such as on banners and other signage items, as well as for small scale general consumer printing. Inkjet printers typically include a number of nozzles configured to eject ink onto a print medium or substrate such as paper. The nozzles are part of a print head which is often integrated into an ink cartridge. The ink cartridge also includes a main ink reservoir where ink is stored before it is fed to the nozzles for ejection onto the print medium. Ink cartridges are typically placed onto a movable platform, often referred to as the carriage, which moves the ink cartridges, and thus the print head nozzles, in relation to the print medium.

As indicated, inkjet printers are often used for general everyday printing of various documents. Most of these documents may not require high quality printing. However, consumers also often use inkjet printers to print photos and other images that, in order to fully satisfy the consumer, need a higher printing quality.

Increasing print quality generally means a need for more nozzles on the print head. Thus, a higher quality printing system is generally more expensive due to the higher nozzle count as well as the complexity required in the supporting systems to address and operate the additional nozzles.

Some inkjet printers are designed to print in multiple modes where some modes are for lower quality everyday printing and other modes are for higher quality image printing. However, such printing systems typically still incur the additional costs resulting from the higher nozzle count in order to achieve the higher quality printing sometimes selected.

BRIEF DESCRIPTION OF THE DRAWINGS

The accompanying drawings illustrate various embodiments of the principles described herein and are a part of the specification. The illustrated embodiments are merely examples and do not limit the scope of the claims.

FIG. 5A is a diagram showing illustrative dot columns placed by a print head as it moves in relation to a print medium, according to one example of principles described herein.

FIG. 5B is a diagram showing an illustrative print head including a number of ink nozzle pair groups, according to one example of principles described herein.

FIG. 5C is a diagram showing an illustrative table illustrating how the firing of primary ink nozzles and secondary ink nozzles may be assigned to time slots, according to one example of principles described herein.

Throughout the drawings, identical reference numbers designate similar, but not necessarily identical, elements.

DETAILED DESCRIPTION

Figure 1:
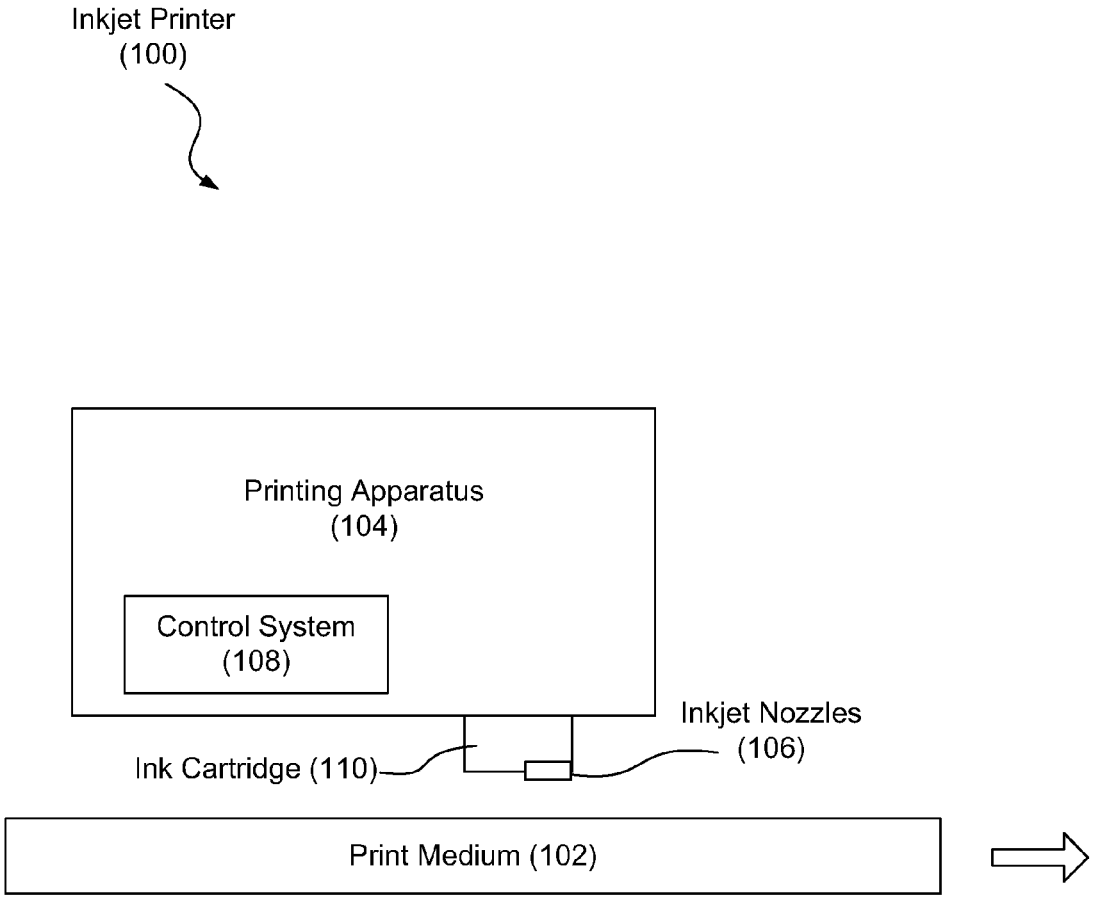
FIG. 1 is diagram showing illustrative inkjet printing principles, according to one example of principles described herein.

As noted above, some inkjet printers are designed to print in multiple modes. Some such modes are for lower quality, everyday printing, while other modes are for higher quality image printing. The present specification relates to systems and methods for multi-mode printing which minimize the supporting structures needed for the higher quality image printing mode.

According to certain illustrative examples, a multi-mode printing system may include a print head with a number of ink nozzle pairs, each ink nozzle pair including a primary ink nozzle and a secondary ink nozzle. Each nozzle pair is supported by a single addressing line. This allows for a smaller number of addressing lines which connect the control system of the printer to the ink nozzle circuitry. A smaller number of addressing lines allows for a simpler and lower cost system to be realized. Additional switching circuitry associated with each nozzle pair may be used to determine which nozzles within the pair fires when selected based on the mode in which the printing system is set.

An illustrative printing system according to the principles disclosed herein may operate in one of at least two modes. When operating in a first printing mode, the ink nozzle pairs may be configured to fire both the primary ink nozzle and the secondary ink nozzle of a selected nozzle pair during a specific time slot. That is, one signal from the printer can cause both nozzles within a nozzle pair to fire. When operating in a second printing mode, the speed at which the carriage moves in relation to the print speed may be reduced. This reduced speed allows for more time slots to be used when printing an image onto the print medium. The additional time slots allow more time for the switching circuitry to separately select the primary ink nozzles and the secondary ink nozzles within each nozzle pair for firing.

The selective firing of either the primary ink nozzle or the secondary ink nozzle of a nozzle pair according to time slots using only a single addressing line will be described in detail below. However, because only a single addressing line is used for a pair of nozzles, the overall number of addressing lines needed is significantly reduced. Additionally, high print quality may be maintained by using more time slots to selectively address either the primary ink nozzles or the secondary ink nozzles within selected nozzle pairs.

As will be appreciated by those skilled in the art, the ability to selectively fire the primary nozzles of a selected ink nozzle pair at a given location, and then fire the secondary ink nozzle of a different nozzle pair allows a finer grained image to be produced while using less addressing lines. A reduced number of addressing lines may reduce the cost of the printing system. Additionally, having less data required to be sent from the control system of the printer to the ink nozzles may allow for overall faster printing speeds.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the term "ink" is to be broadly interpreted as any fluid capable of being ejected onto a print medium to form part of an image on that print medium. Ink may be dyed or contain pigments of specific colors to collectively produce a full-color image on the print medium.

Referring now to the figures, FIG. 1 is a diagram showing an illustrative inkjet printer (100). As described herein, this printer (100) embodies principles and structures described herein.

According to certain illustrative examples of the principles disclosed herein, a printing apparatus (104) of the printer (100) may include a control system (108) and an ink cartridge (110) having a number of inkjet nozzles (106). The printing apparatus (104) may be configured to move a sheet or other print medium (102) past the nozzles (106) as ink is ejected. Additionally or alternatively, the printing apparatus may be configured to move the ink cartridge (110) and nozzles (106) with respect to the print medium (102) as the ink is ejected.

The control system (108) may include components of a standard physical computing system such as a processor and a memory. The memory may include a set of instructions that cause the processor to perform certain tasks related to the printing of images. For example, the control system (108) may manage the various mechanical components within the printing apparatus (104). Additionally, the control system (108) may convert the image data sent from a host or client computing system into the format that is used by the printing apparatus (104) to selectively fire individual nozzles (106).

The ink cartridge (110) may be designed to support several ink pens. A pen includes a specific print head or set of nozzles and supporting systems. Each pen on a cartridge may, for example, use a different color of ink.

As the ink cartridge (110) moves with respect to the print medium (102) and/or the print medium (102) moves underneath the ink cartridge (110), the control system (108) sends a signal to the appropriate inkjet nozzles (106) of the ink pens of the ink cartridges (110) to eject an ink droplet. The ink droplets are ejected in a specific pattern so as to create the intended image on print medium (102), whether in color or monochromatic.

The inkjet nozzles (106) may be configured to eject ink onto the substrate (102) through a variety of methods. One method, known as thermal inkjet printing, includes heating a small ink chamber that contains a droplet of ink. A heating resistor is used to heat the chamber, also known as a firing chamber, to a specific temperature when an electric current is applied. Due to various physical properties, this heating increases the pressure inside the firing chamber which propels the droplet out of the nozzle (106) and onto the print medium (102). The void in the firing chamber then draws more ink into the firing chamber from a main ink reservoir. The control system (108) may be used to cause electric current to flow through the appropriate heating resistors at the appropriate times.

Figure 2A:
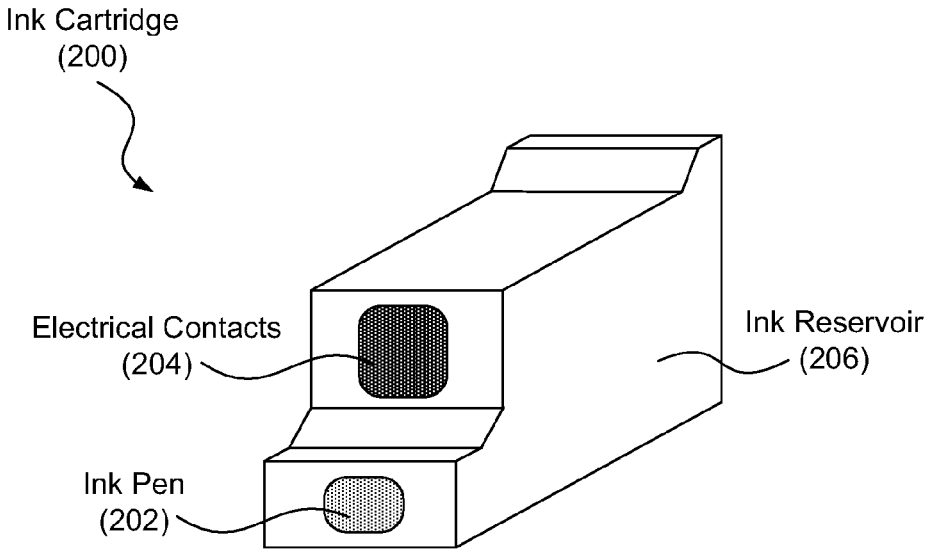
FIG. 2A is a diagram showing a perspective view of an illustrative ink cartridge, according to one example of principles described herein.

FIG. 2A is a diagram showing a perspective view of an illustrative ink cartridge (200). According to certain illustrative examples, the ink cartridge may include at least one ink pen (202), a group of electrical contacts (204) and an ink reservoir (206). Ink cartridges may be designed in a variety of shapes and sizes to fit the specific printers in which they are used. In some cases, an ink cartridge (200) may contain an ink reservoir (206) for only one color of ink. In other cases, an ink cartridge (200) may include a number of ink reservoirs each storing a different ink color.

As noted above, the ink pen (202) may include a separate print head or a grouping of actual physical nozzles that operate together to eject ink to the print medium. As will be described herein, each physical nozzle may be addressed independently. As described above, each physical nozzle is connected to an addressing or fire line. The addressing line is an electrical line configured to carry an electrical signal of sufficient power to heat a resistor associated with that physical nozzle. As described above, the resistor is configured to get hot enough to propel a small droplet of ink from the firing chamber associated with that nozzle. Upon ejecting the ink from the firing chamber, the void in the chamber draws more ink from the main ink reservoir (206).

The various electrical lines such as addressing lines of the ink cartridge (200) interface with the supporting printer (250, FIG. 2B) through an interface composed of a group of electrical contacts (204) on the exterior of the ink cartridge (204). The electrical contacts (204) may be made of an electrically conductive material such as a metallic material. The electrical contacts may be designed to make contact with another set of geometrically similar electrical contacts on a cartridge platform associated with the printer. Thus, an electrical signal may travel from the printer, to an electrical interface on the cartridge platform, through the electrical contacts (204), and ultimately to the ink pen (202).

Figure 2B:
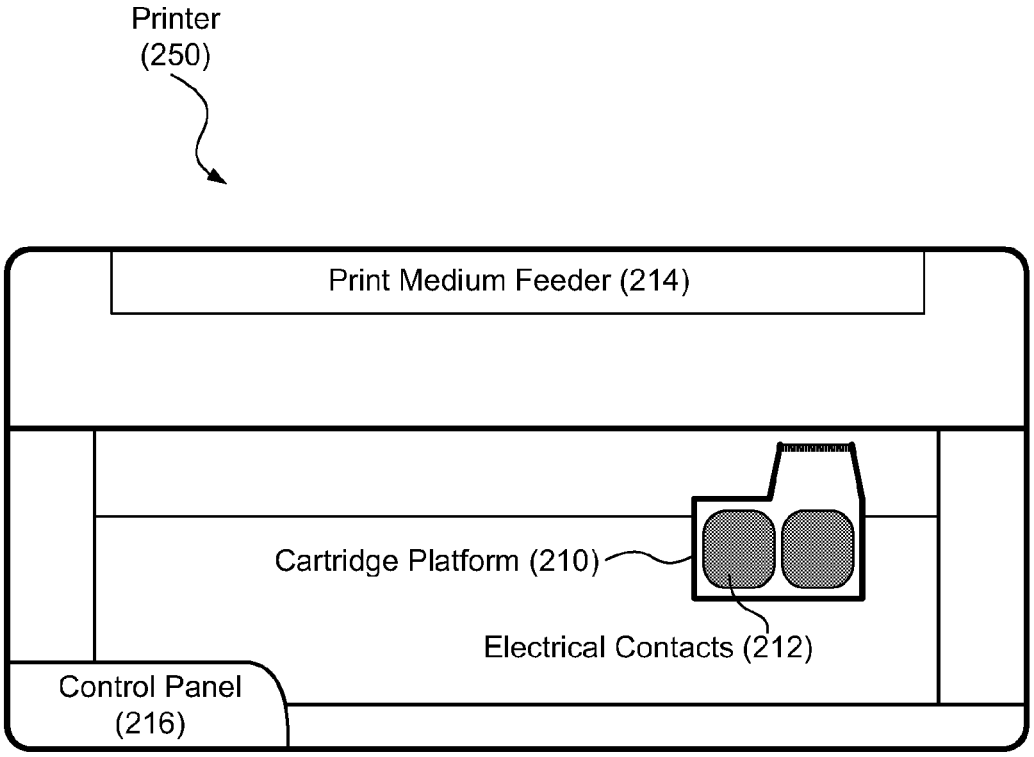
FIG. 2B is diagram showing a top view of an illustrative inkjet printer, according to one example of principles described herein.

FIG. 2B is a diagram showing a top view of an illustrative inkjet printer (250). According to certain illustrative examples, the printer may include a cartridge platform (210) having electrical contacts (212) disposed thereon. The printer (250) may also include a print medium feeder (214) and a control panel (216). A typical printer (250) may have a chassis with a hood that covers the cartridge platform (210). The hood may be lifted to replace ink cartridges or perform other maintenance tasks on the printer (250).

The cartridge platform may be configured to securely hold the ink cartridges (200) used by the printer (250). In some examples, a printer (250) may only use one ink cartridge that holds ink pens for both black ink and colored inks. In other cases, the printer (250) may be designed to use separate ink cartridges for black ink and colored inks.

The cartridge platform (210) may be designed to securely hold the ink cartridge(s) in a manner such that the ink pen(s) (202) of the ink cartridge (200) may be placed within close proximity to a sheet of print medium. In this configuration, the cartridge platform (210) is movable with respect to the path along which the print medium will pass. Thus, as the cartridge platform (210) moves with respect to the print medium, the ink cartridge(s) (200) may receive signals indicating when to fire specific nozzles to form the intended image.

The signals indicating which nozzles are to fire at a specific time are received through the electrical interface of the cartridge platform (210). The electrical interface includes the electrical contacts (212) which, as noted above, are positioned in a manner similar to the corresponding electrical contacts (204) of the ink cartridge (200). A more detailed discussion of the electrical interface will be given below in the text accompanying FIG. 3.

The print medium feeder (214) may be a structure configured to receive a supply of a print medium, usually provided as a stack of sheets, to be used for printing. The printer (250) may pull individual sheets of the print medium through the printer at the desired speed in order to allow the ink to be deposited in the proper locations for the image being printed.

The control panel (216) may be used to allow a user to configured or control the printer (250). This includes allowing the user to make use of various features and options which are available with the printer (250). As such, the control panel (216) may incorporate various devices for facilitating user input, such as buttons and a display device.

Figure 3:
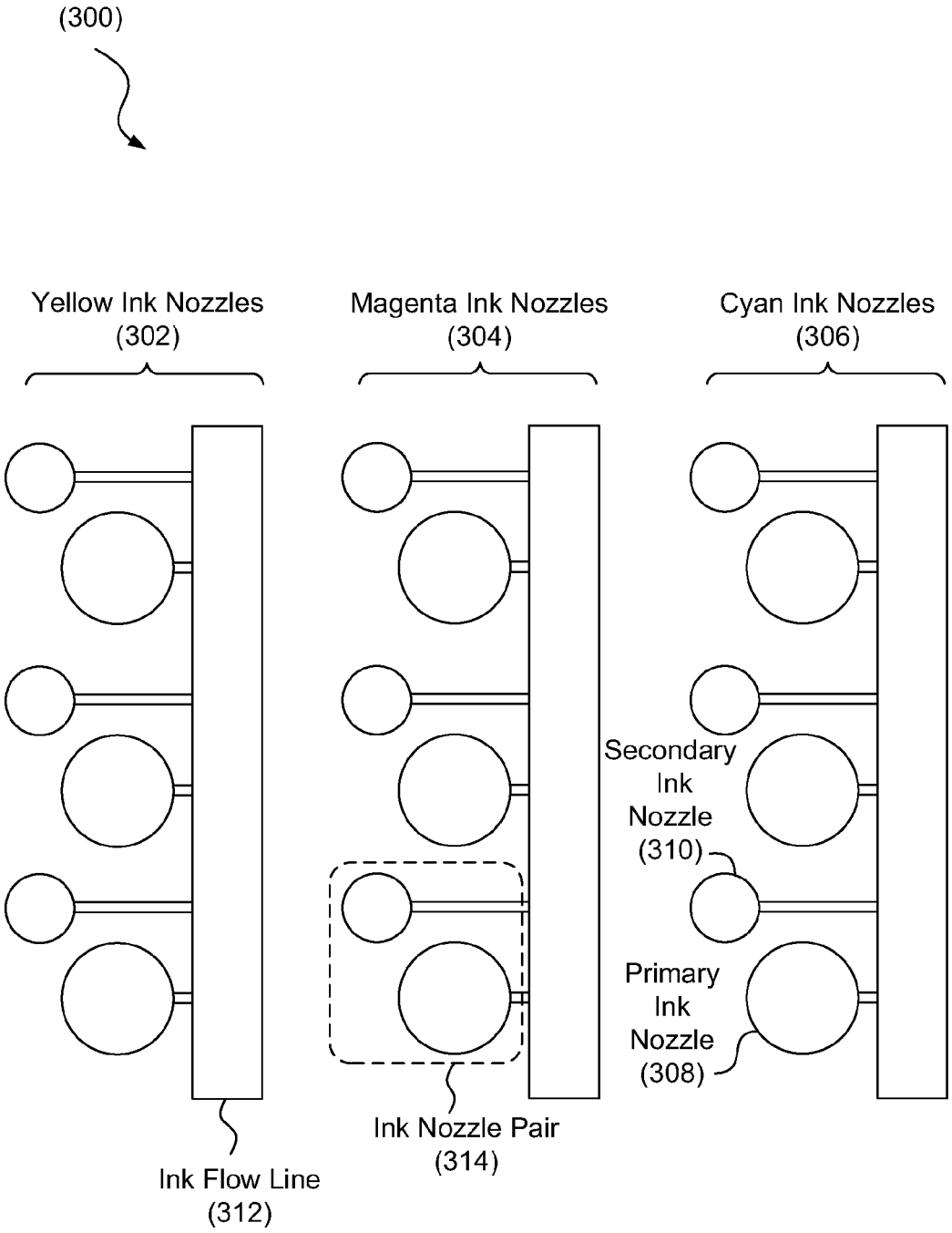
FIG. 3 is a diagram showing illustrative nozzle formation of ink nozzle pairs, according to one example of principles described herein.

FIG. 3 is a diagram showing an illustrative print head (300) with a nozzle configuration of ink nozzle pairs. According to certain illustrative examples, the ink nozzle pairs (314) may be formed in columns, as shown in FIG. 3. Each column may include ink nozzles for depositing a different color of ink. For example, one column may include ink nozzles (302) for yellow ink, one column may include nozzles (304) for magenta ink, and one column may include nozzles (306) for cyan ink.

Within each column, the ink nozzles are arranged in pairs. Each ink nozzle pair (314) may include a primary ink nozzle (308) and a secondary ink nozzle (310). Both ink nozzles (308, 310) may be connected to an ink flow line (312) through which the ink nozzles (308, 310) receive ink from an ink reservoir.

Each ink nozzle pair (314) may be individually addressed. The control system of the printer may send signals to the nozzle pairs (314) as the print head (300) moves in relation to the print medium. At specified time intervals, when a particular nozzle pair (314) is above a specific location on the print medium, the nozzle pair may be configured to fire based on the signal received from the control system of the printer. Upon firing, the nozzle pairs (314) may eject one or two droplets of ink onto the print medium as will be described in more detail below.

The ink flow lines (312) may be used to supply ink to the nozzle pairs (314) along a column. As the nozzles (308, 310) eject droplets of ink, they will need to refill their respective firing chambers. As noted above, the ink firing chamber is a small chamber designed to store one droplet of ink. When that droplet of ink is ejected, the firing chamber is refilled. The firing chambers are refilled, as described herein, with ink supplied through the ink flow lines (312).

Figure 4:
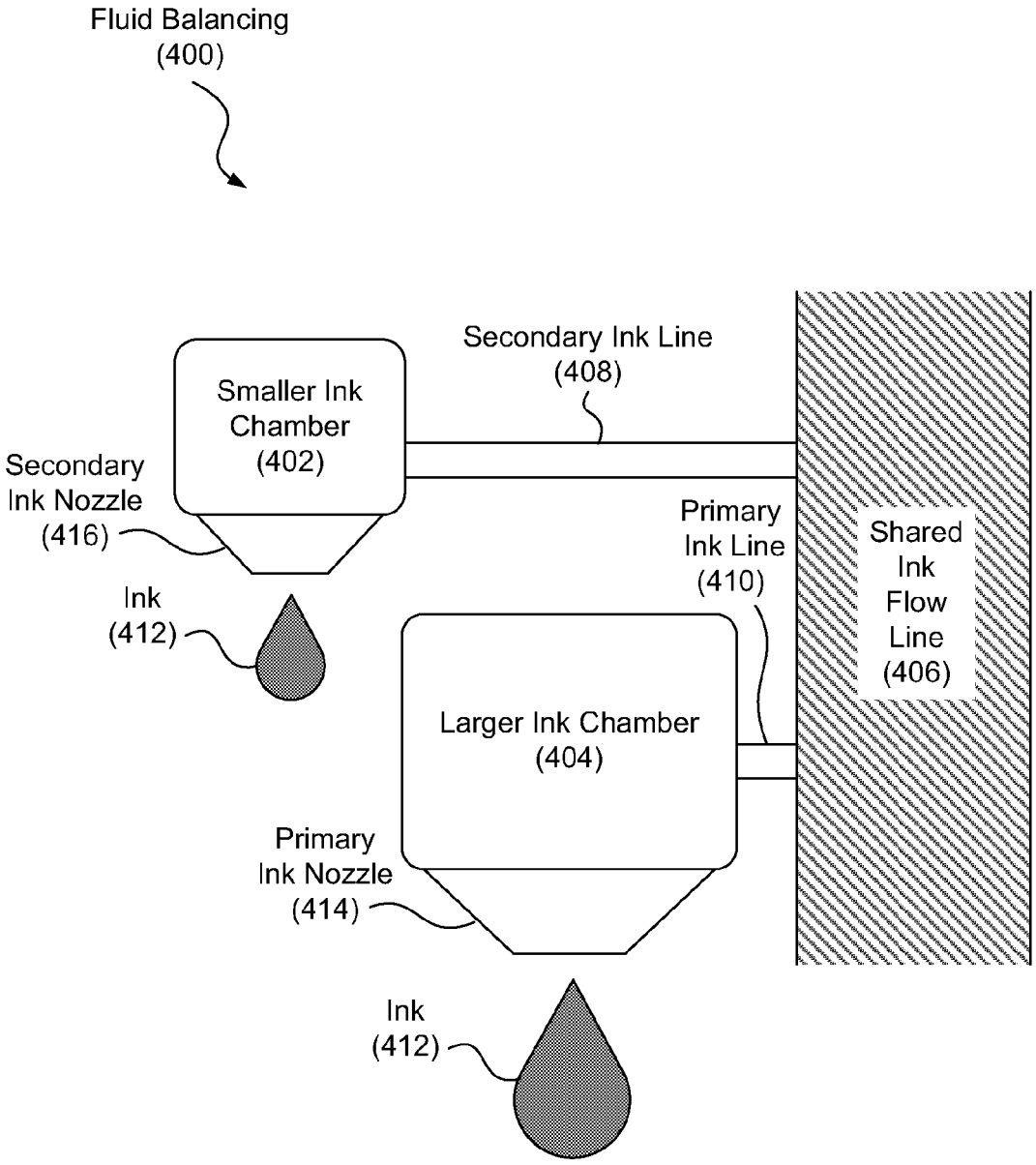
FIG. 4 is a diagram showing illustrative ink nozzle pair fluid balancing, according to one example of principles described herein.

FIG. 4 is a diagram showing illustrative ink nozzle pair fluid balancing (400). According to certain illustrative examples, a primary ink line (410) may connect the primary ink nozzle (404) to the shared ink flow line (406). Additionally, a secondary ink line (408) may connect the secondary ink nozzle (414) to the shared ink flow line (406).

In some examples, the primary ink nozzle (414) may be larger than the secondary ink nozzle (416). Accordingly, the firing chamber (404) of the primary ink nozzle (414) may be larger than the firing chamber (402) of the secondary ink nozzle (416). Thus, the primary ink nozzle (414) is configured to eject a droplet of ink (412) having a larger volume than a droplet of ink (412) ejected from a secondary ink nozzle (416).

In some examples, the secondary ink nozzle (416) may be placed at a farther distance from the shared ink flow line (406) than the primary ink nozzle (414). As such, the primary ink line (410), which supplies ink from the shared ink flow line (406) to the primary ink nozzle (414), may be shorter than the secondary ink line (408), which supplies ink from the shared ink flow line (406) to the secondary ink nozzle (416). Thus, the rate at which the firing chamber (402) of the secondary ink nozzle (416) receives ink from the shared flow line (406) may be slower than the rate at which ink is supplied to the closer primary ink nozzle (414). However, because the ink chamber (402) of the secondary ink nozzle (416) is smaller than the ink chamber (404) of the primary ink nozzle (414), it takes less ink to refill the ink chamber (402) of the secondary ink nozzle.

The relative size of each ink nozzle (414, 416) and the distance from the shared ink flow line (406) of each nozzle may be designed in a manner that causes the total time needed to refill the respective firing chambers (402, 404) of both ink nozzles (414, 416) to be substantially the same. Thus, if both the primary ink nozzle (414) and the secondary ink nozzle (416) are fired at the same time, they will both be refilled and ready to fire again in approximately the same amount of time. By balancing the fluid flow between both nozzles (414, 416), the printer may be able to operate more effectively at overall higher speeds.

FIG. 5A is a diagram showing illustrative dot columns (506) placed by a print head (502) as it moves in relation to a print medium. According to certain illustrative examples, a print head may be configured to place several parallel columns of dots (506) as it moves in relation to a print medium. The dot columns may be perpendicular to the direction (504) in which the print head moves. When viewed from afar, the human eye is generally unable to detect the placement of dot columns (506). Rather, the dot columns (506) appear as one continuous image.

In general, a print head is not designed to fire all of the selected ink nozzles along its entire length (508) simultaneously. Rather, the ink nozzles along the length (508) of the print head (502) are divided into a number of ink nozzle groups. Each ink nozzle group may be assigned a time slot. The number of time slots needed to place a single dot column (506) may be directly related to the number of ink nozzle groups of the print head (502). Each ink nozzle group is assigned to at least one different time slot. Thus, during a particular time slot, a selected subset of ink nozzle pairs within an ink nozzle group are simultaneously fired.

FIG. 5B is a diagram showing an illustrative print head including a number of ink nozzle groups (510, 512, 514, 516). As mentioned above, each ink nozzle group (510, 512, 514, 516) may be assigned at least one time slot. The number of time slots assigned to an ink nozzle group may be based on the mode in which the printer is currently set. In the configuration illustrated, the print head is divided up into four ink nozzle groups. Thus, at least four time slots are needed to print one dot column (506). The example shown in FIG. 5B is a simplified example for illustrative purposes. A practical print head may include a higher number of ink nozzle groups and thus utilize a higher number of time slots per dot column (506). For example, a print head may include 14 ink nozzle groups, each ink nozzle group including 12 ink nozzle pairs. Such a print head would include 168 ink nozzles along the entire length (508) of the print head. A print head (502) as shown in FIG. 5B is for a single color only. As will be appreciated by those skilled in the relevant art, an ink cartridge may include three print heads, each of a different color.

As mentioned above, a printer embodying principles described herein may be configured to operate in a first mode used for every day standard documents where a high quality print job may not be needed. In this mode, the print head (502) may be configured to fire both the primary ink nozzles and the secondary ink nozzles of each nozzle pair in unison during its respective time slot as if the ink nozzles were one ink nozzle. To place a particular dot column (506), the print head (502) may utilize four time slots, one for each ink nozzle group (510, 512, 514, 516). During time slot 1 of 4, the selected nozzle pairs within ink nozzle group 1 (510) are fired; during time slot 2 of 4, the selected nozzle pairs within ink nozzle group 2 (512) are fired; during time slot 3 of 4, the selected nozzle pairs within ink nozzle group 3 (514) are fired; and during time slot 4 of 4, the selected nozzle pairs within ink nozzle group 4 (514) are fired.

In some examples, each ink nozzle group (510, 512, 514, 516) may be slightly offset from the other ink nozzle groups. This compensates for the fact that the print head is in constant motion as the ink nozzles within different ink nozzle groups are fired successively. The offset allows a straighter dot column (506) to be placed onto the print medium.

According to certain illustrative examples, the printer may be configured to operate in a second printing mode. While in the second printing mode, the speed at which the carriage moves in relation to the print head may be reduced to half-speed. Thus, twice the number of time slots may be available for each dot column (506) placed onto the print medium. For example, in the case of a print head as illustrated in FIG. 5B, eight time slots may be used to print a single dot column (506), two time slots for each ink nozzle group. Of the two time slots assigned to an ink nozzle group, one time slot may be used to fire the primary ink nozzles and the other time slot may be used to fire the secondary ink nozzles.

FIG. 5C is a diagram showing an illustrative table illustrating how primary ink nozzles and secondary ink nozzles may be assigned time slots (518). According to certain illustrative examples, switching circuitry for each ink nozzle pair may be configured to set either the primary ink nozzle or the secondary ink nozzle within the pair to be fired when the ink nozzle pair is selected to fire during its respective time slot (518). The switching circuitry will be described in greater detail below with the text accompanying FIG. 6.

The table in FIG. 5C illustrates two examples (520, 522) of orders in which the primary and secondary ink nozzles pairs may be fired. A number and a letter are used to designate which ink nozzles are to be fired during a specific time slot (518). The number represents the ink nozzle group and the letter, either an 'S' or a 'P', indicates either the Secondary ink nozzles or the Primary ink nozzles respectively. For example, the designation '1S' indicates the secondary ink nozzles of the nozzle pairs in ink nozzle group 1 (510) is fired.

In Example 1 (520), an ink nozzle pair fires its secondary nozzles during a time slot and its primary nozzles during the subsequent time slot. The order may then proceed through each ink nozzle group successively firing the secondary nozzles during its respective time slot and firing the primary ink nozzles during the subsequent time slot. In this example, if a particular ink nozzle pair from ink nozzle group 1 (510) is selected during the first time slot, and that same ink nozzle pair from ink nozzle group 1 (510) is selected during the second time slot, then that ink nozzle pair fires both its secondary ink nozzle and its primary ink nozzle successively. The exact timing between subsequent time slots may be small enough so that the primary ink nozzle may place a dot which overlaps the dot placed by the secondary ink nozzle.

In Example 2 (522), the secondary ink nozzles from all ink nozzle groups are fired during the first four time slots. During the remaining four time slots, the primary ink nozzles from each group are fired. In this example, if a particular ink nozzle pair from ink nozzle group 1 (510) is selected during the first time slot, and that same ink nozzle pair from ink nozzle group 1 (510) is selected during the fifth time slot, then that ink nozzle pair fires its secondary ink nozzle and then wait four time slots before firing its primary ink nozzle. The exact timing between subsequent time slots may be such that four time slots is enough time so that the print head moves far enough to cause the dot placed by the primary ink nozzle be far enough away from the dot placed by the secondary ink nozzle so that there is no overlap.

The two examples (520, 522) illustrated in FIG. 5C are not an exhaustive set of the manner in which ink nozzles may be assigned time slots. Various other time slot assignments may be made. The manner in which primary and secondary ink nozzles are assigned to the available time slots can affect how the dots are placed onto the print medium along each column.

Figure 6:
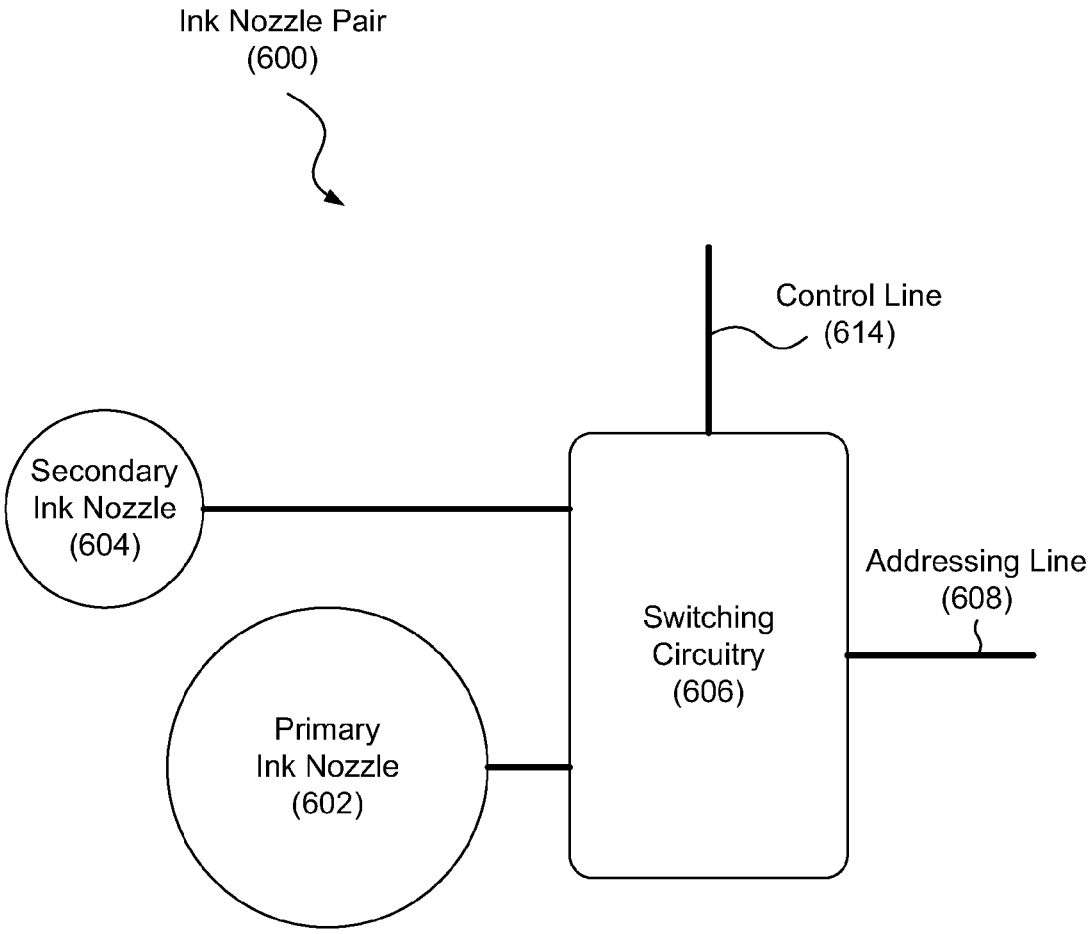
FIG. 6 is a diagram showing illustrative switching of an ink nozzle pair, according to one example of principles described herein.

FIG. 6 is a diagram showing illustrative switching of an ink nozzle pair (600). According to certain illustrative examples, both the primary ink nozzle (602) and the secondary ink nozzle (604) of each nozzle pair (616) may be connected to switching circuitry (606). The switching circuitry (606) may be connected to the control system (108, FIG. 1) of the printer through various data lines such as a control line (614) and an addressing line (608), also sometimes referred to as a select line.

The switching circuitry (606) is used to select which ink nozzles within the ink nozzle pair are fired during which mode. As mentioned above, while in the first printing mode, an ink nozzle pair (600) is configured to fire both the primary ink nozzle (602) and the secondary ink nozzle (604) within a selected ink nozzle pair during its appropriate time slot. A particular ink nozzle pair may know if it is selected or not based on a signal received from the control system of the printer via the addressing line (608). For example, during the time slot in which an ink nozzle group to which the ink nozzle (600) belongs, the ink nozzle pair fires both ink nozzles (602, 604) if the appropriate signal is being received from the control system via the addressing line (608).

While in a second mode, the switching circuitry (606) may be configured to select either the primary ink nozzle (602) or the secondary ink nozzle (604) during a particular time slot. For example, during the time slot for which the secondary ink nozzles of an ink nozzle group to which the ink nozzle pair (600) belongs, the switching circuitry (606) may be configured to fire the secondary ink nozzle (604) if the appropriate signal is received from the control system via the addressing line (608).

The switching circuitry (606) determines the current mode to which the printer is set based on a signal received through the control line (614). Thus the switching circuitry (606) can perform its intended functions related to each respective printing mode based on a signal received from the control system of the printer via the control line (614).

Figure 7:
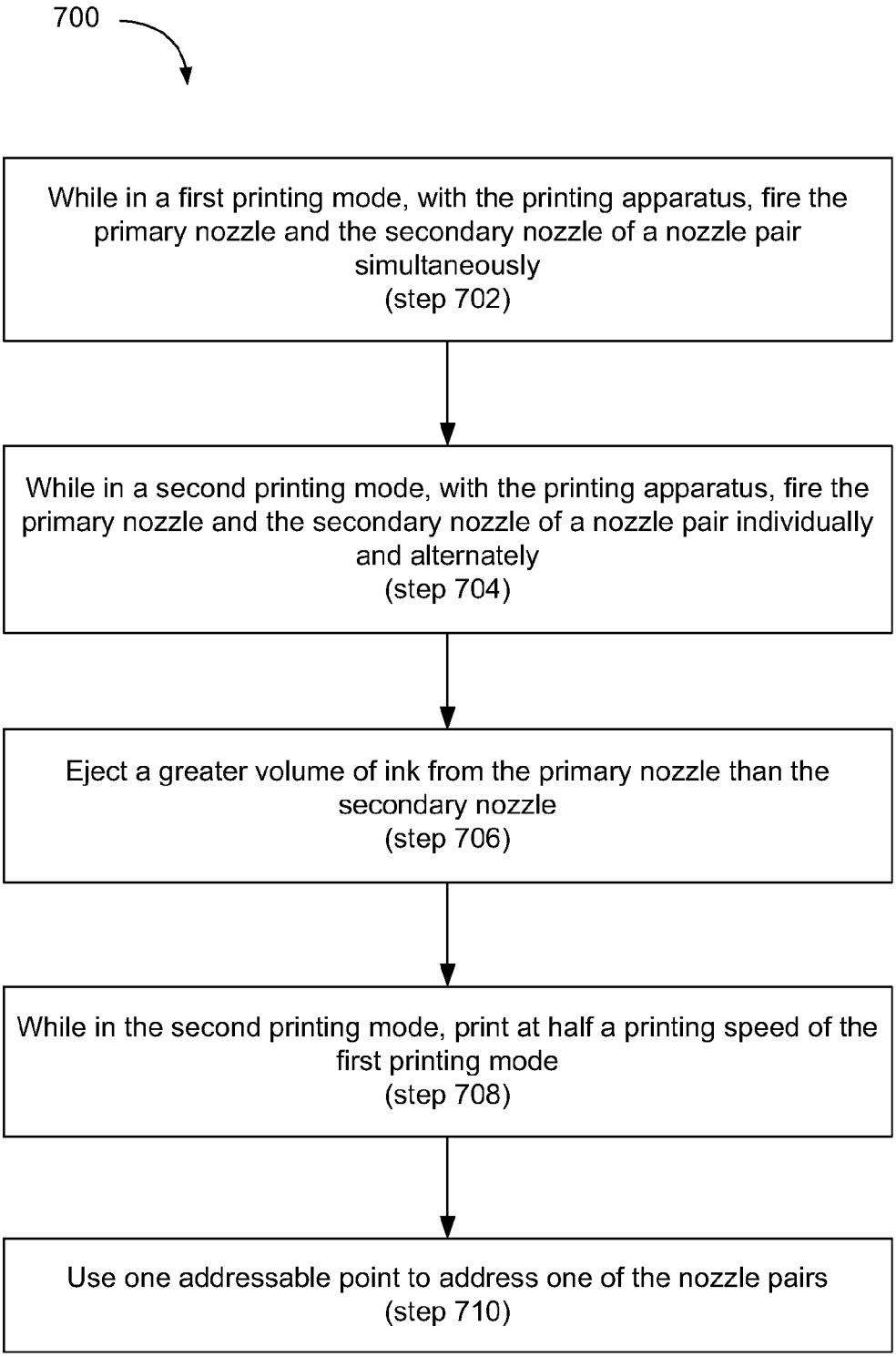
FIG. 7 is a flowchart showing an illustrative method for multi-mode printing, according to one example of principles described herein.

FIG. 7 is a flowchart showing an illustrative method (700) for multi-mode printing. According to certain illustrative examples, the method may be performed by a printing apparatus that includes a print head having a number of nozzle pairs, each nozzle pair including a primary ink nozzle and a secondary ink nozzle. The method (700) may include, while in a first printing mode, with the printing apparatus, firing (step 702) the primary ink nozzle and the secondary ink nozzle of a nozzle pair simultaneously; and while in a second printing mode, with the printing apparatus, firing (step 704) the primary ink nozzle and the secondary ink nozzle of a nozzle pair individually and alternately. The method may further include ejecting (706) a greater volume of ink from the primary ink nozzle than the secondary ink nozzle; while in the second printing mode, printing (step 708) at half a printing speed of the first printing mode; and using (step 710) one addressable point to address one of the nozzle pairs.

In sum, through use of a printing system embodying principles described herein, a lower cost multi-mode printer may be realized. The lower cost may result from a lower addressable nozzle count than physical nozzle count. The lower addressable nozzle count may allow a smaller electrical interface between the ink pens and the printer's control system. With the lower addressable nozzle count, the printing system may maintain quality through use of additional circuitry used to determine how the ink nozzles of an ink nozzle pair are fired when addressed by the control system.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A printing system for multi-mode printing, the printing system comprising a print head, the print head comprising:

a number of nozzle pairs, each nozzle pair comprising a primary ink nozzle and a secondary ink nozzle; and switching circuitry for selectively firing either or both of said nozzles in a selected pair within one of a number of time slots based on a current print mode.

2. The system of claim 1, in which said second ink nozzle is placed at a farther distance from a shared ink flow line than a distance at which said primary ink nozzle is placed from said shared ink flow line.

3. The system of claim 1, in which said primary ink nozzle can eject a larger volume of ink than said secondary ink nozzle.

4. The system of claim 1, in which said nozzle pairs are divided into a number of ink nozzle groups, each ink nozzle group corresponding to at least one of said number of time slots.

5. The system of claim 1, in which a single address line communicates with said switching circuitry for each pair of nozzles.

6. The system of claim 1, in which said switching circuitry, in a first printing mode, fire both said primary ink nozzle and said secondary ink nozzle of said nozzle pair in unison during said one of said number of time slots.

7. The system of claim 1, in which said switching circuitry, in a second printing mode, selectively fire only one of said nozzles in a selected nozzle pair within said one of said number of time slots.

8. The system of claim 7, in which while in said second printing mode, a carriage holding said print head moves in relation to said print medium at half a speed of said carriage while in said first mode, said half a speed allowing twice said number of time slots.

9. The system of claim 8, in which a first half of said twice said number of time slots are used to fire said primary ink nozzles and a second half of said twice said number of time slots are used to fire said secondary ink nozzles.

10. A method for multi-mode printing performed by a printing apparatus comprising a print head comprising a number of nozzle pairs, each nozzle pair comprising a primary ink nozzle and a secondary ink nozzle, the method comprising:

while in a first printing mode, with said printing apparatus, firing said primary ink nozzle and said secondary ink nozzle of a nozzle pair simultaneously during one of a number of time slots; and while in a second printing mode, with said printing apparatus, alternately firing said primary ink nozzle and said secondary ink nozzle of said ink nozzle pairs between subsequent time slots.

11. The method of claim 10, in which said switching circuitry, in a first printing mode, fire both said primary ink nozzle and said secondary ink nozzle of said nozzle pair in unison during said one of said number of time slots.

12. The method of claim 11, in which said switching circuitry, in a second printing mode, selectively fire only one of said nozzles in a selected nozzle pair within said one of said number of time slots.

13. The method of claim 12, in which while in said second printing mode, a carriage holding said print head moves in relation to said print medium at half a speed of said carriage while in said first mode, said half a speed allowing twice said number of time slots.

14. The method of claim 13, in which a first half of said twice said number of time slots are used to fire said primary ink nozzles and a second half of said twice said number of time slots are used to fire said secondary ink nozzles.

15. A printing apparatus comprising:

a control system comprising a processor and a memory communicatively coupled to said processor;

a print head comprising a number of nozzle pairs, each nozzle pair comprising a primary ink nozzle and a secondary ink nozzle;

in which said processor of said control system:

while in a first printing mode, fire said primary ink nozzle and said secondary ink nozzle of a nozzle pair simultaneously during one of a number of time slots; and while in a second printing mode, fire said primary ink nozzle and said secondary ink nozzle of a nozzle pair alternately between subsequent time slots.

16. The printing apparatus of claim 15, in which said second ink nozzle is placed at a farther distance from a shared ink flow line than a distance at which said primary ink nozzle is placed from said shared ink flow line.

17. The printing apparatus of claim 15, in which said nozzle pairs are divided into a number of ink nozzle groups, each ink nozzle group corresponding to at least one of said number of time slots.

18. The printing apparatus of claim 15, in which said processor, in a first printing mode, fires both said primary ink nozzle and said secondary ink nozzle of said nozzle pair in unison during said one of said number of time slots.

19. The printing apparatus of claim 15, in which said processor, in a second printing mode, selectively fires only one of said nozzles in a selected nozzle pair within said one of said number of time slots.

* * * * *